US006004248A

United States Patent [19]

Price

[11] Patent Number: 6,004,248

[45] Date of Patent: Dec. 21, 1999

[54] EXERCISE APPARATUS

[75] Inventor: Shawn Price, Reno, Nev.

[73] Assignee: Price Advanced Innovations, Inc., Reno, Nev.

[21] Appl. No.: 09/113,927

[22] Filed: Jul. 10, 1998

[51] Int. Cl.[6] ..... A63B 21/02

[52] U.S. Cl. ..... 482/121; 482/122; 482/123; 482/135; 482/129; 482/130; 482/140

[58] Field of Search ..... 482/121, 122–123, 482/140, 129–130, 135

[56] References Cited

U.S. PATENT DOCUMENTS 4,231,568 11/1980 Riley et al. .
4,256,302 3/1981 Keiser et al. .
4,421,307 12/1983 Cunnington et al. .
4,492,375 1/1985 Connelly .
4,521,013 6/1985 Dofel .
4,603,857 8/1986 Chipman et al. .
4,709,918 12/1987 Grinblat .
5,029,850 7/1991 van Straaten .
5,154,684 10/1992 Delf .
5,261,864 11/1993 Fitzpatrick .
5,267,930 12/1993 Henes .
5,348,524 9/1994 Grant .
5,385,525 1/1995 Davis .
5,645,514 7/1997 Chen .
5,700,232 12/1997 Clausen et al. .

*Primary Examiner*—Richard J. Apley
*Assistant Examiner*—Lori Baker-Smith
*Attorney, Agent, or Firm*—Reising, Ethington, Barnes, Kisselle, Learman & McCulloch, P.C.

[57] ABSTRACT

Exercise apparatus has a base to which is pivoted one end of a rockable arm, the opposite end of which is coupled to one end of a force transmitting line by means of which the arm may be rocked from and to a rest position. Movement of the arm away from the rest position is yieldably opposed by elastic resistance members which react between the rockable arm and the base. An upright arm is removably supported by the base and is equipped with one or more line guides about which the force transmitting line may be reeved. In one embodiment the line guide automatically compensates for variations in the force which must be applied on the rockable arm to overcome variations in the resistance of the resistance members.

18 Claims, 4 Drawing Sheets

10
29
30
6
7
8
30
28
29
9
23
2
17
19
20
13
15
25
12
22
16
21
9
3
24
4
27
5
14
1
12
11

5
9
19
17
18
2
6
15
20
3
16
11

9
2
5
31
13
6
1
3
18

EXERCISE APPARATUS

This invention relates to exercise apparatus and more particularly to such apparatus which is portable and capable of enabling a large number of exercises to be performed without requiring either a plurality of attachments or extensive rearrangement of the parts of such apparatus.

BACKGROUND OF THE INVENTION

There presently exists a great variety of apparatus usable by individuals to perform a plurality of exercises. Although most of the known apparatus is useful for the purposes intended, many of them are heavy, cumbersome, difficult to adjust, and limited in the applications in which they may be used. In addition, many of the known devices which are capable of enabling the user to perform a variety of exercises have a plurality of components which, in many instances, must be substituted for one another or rearranged. In some cases the substitution of some parts for others or the rearrangement of parts requires considerable dismantling and reassembling of parts of the apparatus which not only is technically complex, but also time consuming.

To obtain optimum results from an exercise regimen it is necessary that a program be developed and followed and requires the user to perform specific exercises periodically. However, many persons who wish to obtain the benefits of specific programs cannot do so due to their having to travel or otherwise be away from their homes or local gymnasiums where their exercise apparatus is housed.

A principal object of the invention is to provide exercise apparatus which overcomes or minimizes the foregoing disadvantages of currently available exercise equipment.

SUMMARY OF THE INVENTION

Exercise apparatus constructed in accordance with preferred embodiments of the invention is lightweight, portable, easily assembled and disassembled, and capable of enabling the user to perform a plurality of specific exercises without significant modification or rearrangement of component parts of the apparatus.

The portability of the apparatus enables it easily to be packed and carried in a gym bag or case and its size is such as to enable it to be accommodated in carry-on luggage space provided in aircraft.

The component parts of the invention are so constructed that, with very simple adjustments requiring the use of no tools, the user may perform exercises that require the imposition of resistance in upward, downward, or substantially horizontal directions.

Apparatus constructed in accordance with the invention also enables an exceptionally large range of movement of the user-held actuator while still enabling the components of the apparatus to be sufficiently compact to accommodate portability requirements.

The apparatus is so constructed that the user may perform exercises that require the application of both positive and negative resistances of selected values and wherein a selected resistance value may remain substantially constant over the full range of a selected exercise.

In one embodiment of the apparatus variations in the resistance associated with movements of movable components are compensated for automatically so as to enable the resistance level to be substantially uniform throughout the movements.

THE DRAWINGS

The presently preferred embodiments of the invention are illustrated in the accompanying drawings wherein.

THE PREFERRED EMBODIMENTS

Figure 1:
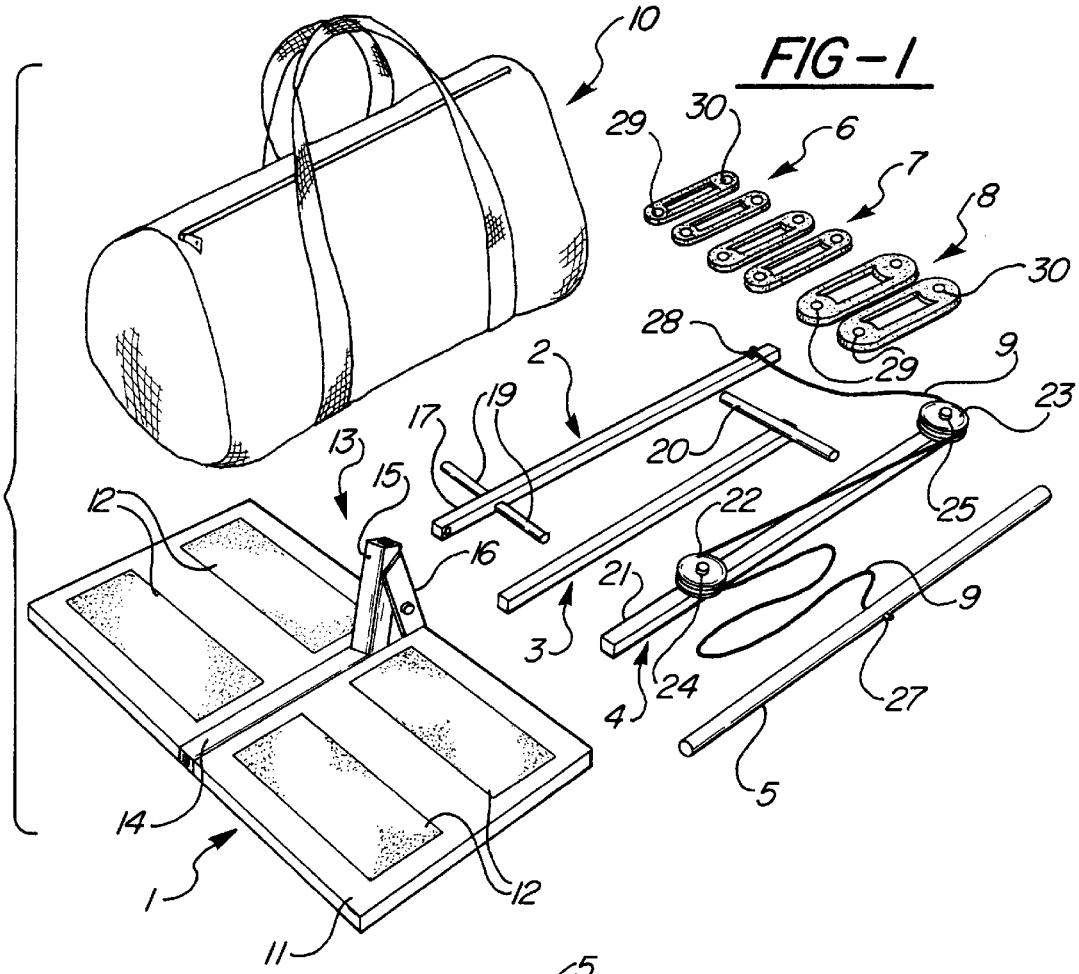
FIG. 1 is an isometric view of the parts of the apparatus in disassembled condition.

Apparatus constructed in accordance with the embodiment shown in FIGS. 1–8 comprises a base 1, a rocker arm 2, an anchor member 3, an upright arm 4, and a user-held actuator bar 5. The apparatus also includes a plurality of pairs of resistance members 6, 7, and 8 of varying resistances, and a flexible force transmitting line, cord, or rope 9. All of the components 1–9 may be assembled and disassembled and, when disassembled, accommodated in a gym bag 10 of conventional size and construction. In a typical construction the apparatus weighs about 22 pounds.

The base 1 comprises a rectangular frame 11 having on its upper surface anti-skid treads 12 on which a person may stand, kneel, or sit. Between adjacent pairs of treads is a mounting member 13 forming part of the frame 11 and comprising a square tube 14 having at one end thereof an upstanding, square sleeve 15 and a brace 16. If desired, the tube 14 could be sufficiently long to enable the sleeve 15 and the brace 16 to project beyond the adjacent edge of the base.

Figure 2:
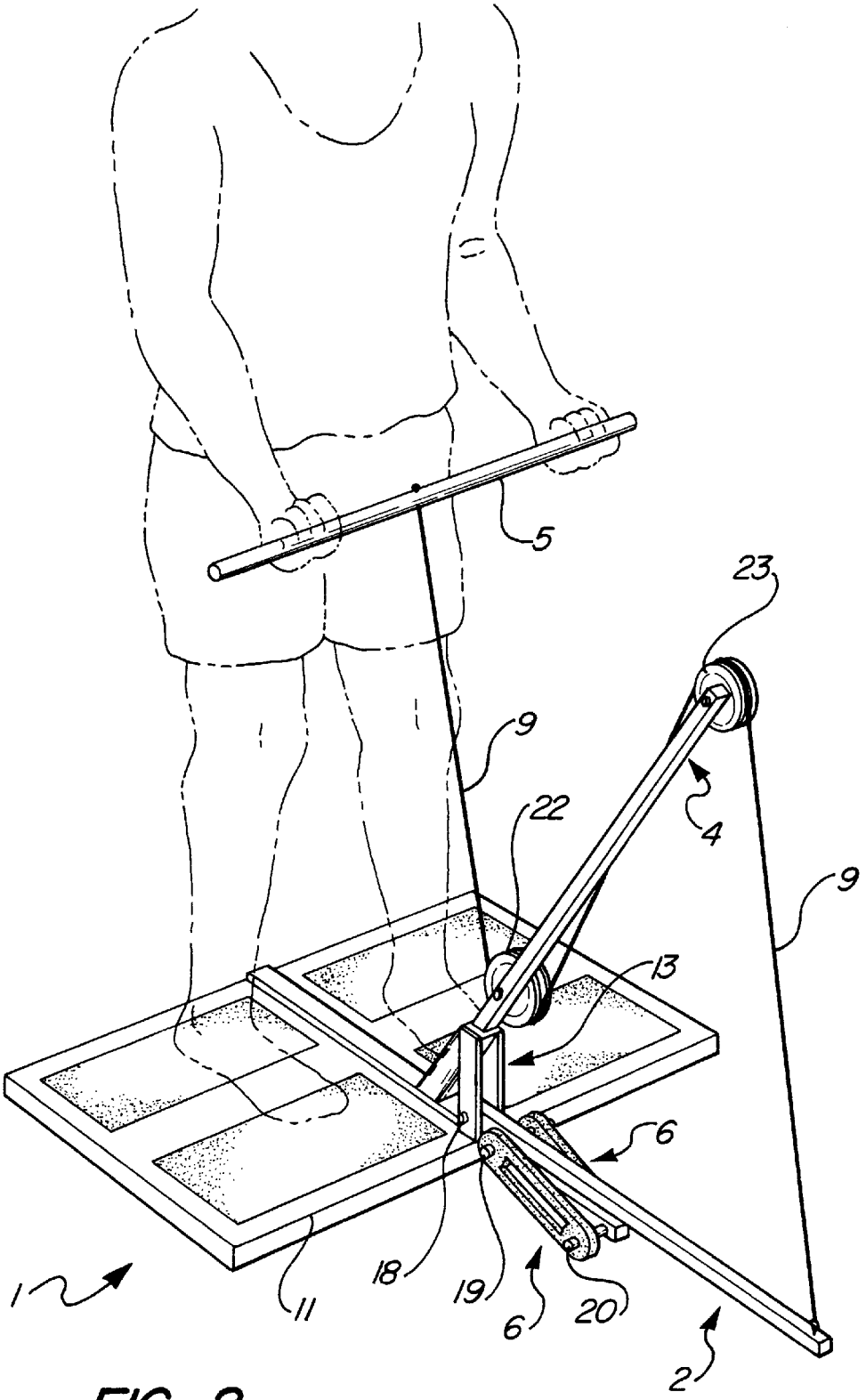
FIG. 2 is an isometric view illustrating the component parts assembled in such manner as to enable a user to perform one or more selected exercises.
Figure 7:
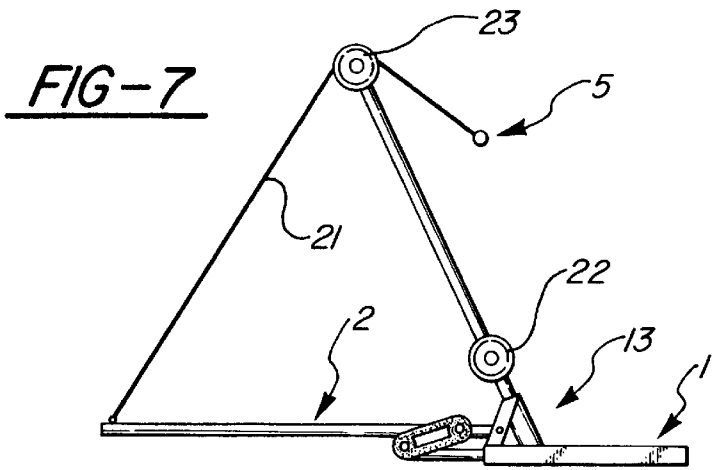
FIG. 7 is a view similar to FIG. 5, but illustrating the parts in another condition of assembly.
Figure 8:
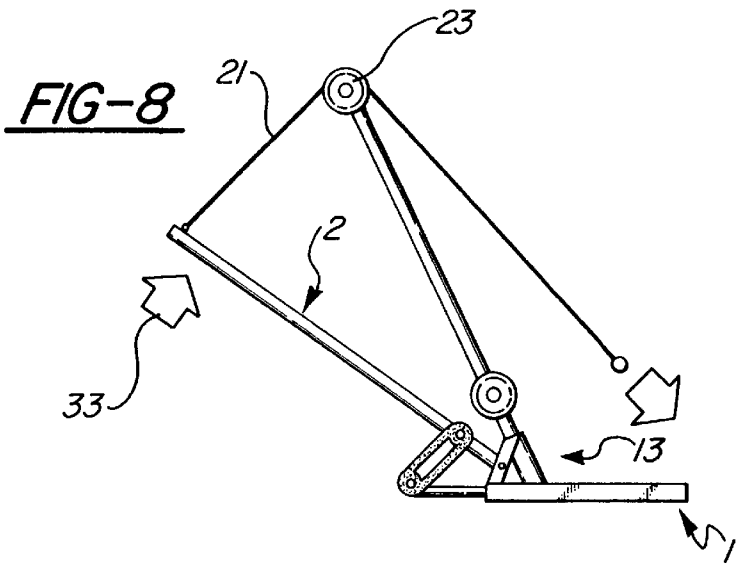
FIG. 8 is a view of the apparatus of FIG. 7 but showing the parts in adjusted positions.

The brace 16 comprises two bars spaced apart a distance sufficient to enable one end 17 of the rocker arm 2 to be accommodated therebetween. The bars of the brace 16 and the end 17 of the rocker arm 2 are provided with openings for the accommodation of a pivot pin 18 that is best shown in FIG. 2, and enables the rocker arm to be rocked freely about the axis of the pivot pin. The rocker arm 2 also is provided with anchor rods 19 adjacent the end 17 and which project transversely on opposite sides of the arm 2.

The anchor member 3 is of such size as to be slideably and removably accommodated in the sleeve 14 in underlying relation to the rocker arm 2. The member 3 carries a transverse anchor rod 20 that is located forwardly of the rod 19 when the parts are in assembled condition.

The upright arm 4 has one end 21 of such size as to be accommodated removably in the sleeve 15 and extend upwardly from the base at an angle to the vertical. In the embodiment shown in FIGS. 1–8 the upright arm 4 supports two spaced apart line guides 22 and 23 forming parts of force transmitting means and which are rotatable about horizontal axes and 25, respectively. The guide 22 is sufficiently spaced from the adjacent end of the upright arm 4 as to avoid interference with the mounting member 13, and the guide 23 preferably is closely adjacent the free end of the arm 4.

The actuator bar 5 has secured thereto one end of the flexible, force transmitting line 9 by means of a clip or clamp 27, the opposite end of the line 9 being secured by a suitable clip or clamp 28 adjacent the free end of the rocker arm 2. In the form shown, the guides 22 and 23 comprise grooved pulleys about either or both of which the line 9 may be reeved.

Figure 3:
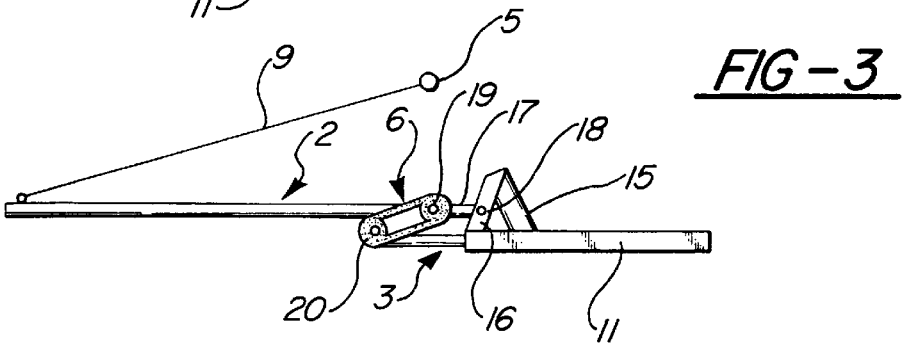
FIG. 3 is a diagrammatic side elevational view illustrating the parts assembled in such manner as to perform another exercise.

The apparatus disclosed in the embodiment of FIGS. 1–8 is completed by a plurality of pairs of resistance members 6, 7, and 8. In each instance the resistance member is formed of elastic material such as rubber or rubber-like material yieldably resistant to elongation and has openings 29 and 30 at its opposite ends. The length of each resistance member is such that the space between the openings 29 and 30 corresponds substantially to the spacing between the anchor rods 19 and 20 when the rocker arm 2 is in its at rest position as shown in FIG. 3, for example. The resistance to elongation of each member of a pair of resistance members is the same, but such resistance preferably varies from one pair to another.

To condition the apparatus thus far disclosed for operation to perform a particular exercise, such as rowing, the anchor member 3 is fitted into the square tube 14, the rocker arm 2 is pivoted to the mounting member brace 16, and one or more pairs of resistance members 6–8 are coupled to the anchor rods 19 and 20, respectively, of the rocker arm 2 and the anchor member 3. See FIG. 3. In this instance the upright arm 4 is not used.

Figure 4:
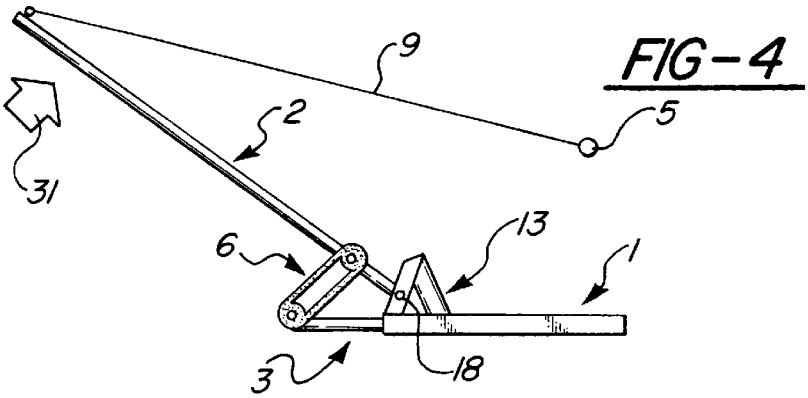
FIG. 4 is a view similar to FIG. 3, but showing the parts in adjusted positions.

When the parts are assembled as illustrated in FIG. 3, the user may stand or sit upon the upper surface of the base 1, grasp the actuator bar 5, and exert a force on the actuator bar via the line 9 to rock the rocker arm 2 in the direction of the arrow 31 (FIG. 4). The force applied by the user on the actuator bar 5 may be horizontal or somewhat upward or downward. In any event, the rocker arm 2 will be rocked upwardly about its pivot axis 18 and such movement will be resisted by the resistance members 6 which rock about the axes of the rods 19 and 20 as they stretch. As long as the force applied to the rocker arm 2 is such as to cause it to rock upwardly, the applied force is considered to be positive. When the force is relaxed, the elasticity of the resistance members will restore the rocker arm 2 to its normal, at rest position and the force thus applied on the user by the line and the actuator bar as the rocker arm returns to its at rest position is considered to be negative.

Figure 5:
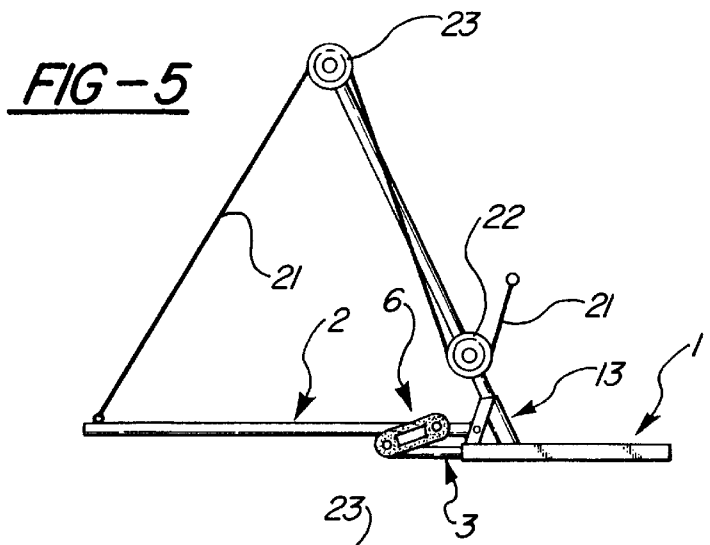
FIG. 5 is a view similar to FIG. 3 but illustrating the parts in another condition of assembly.
Figure 6:
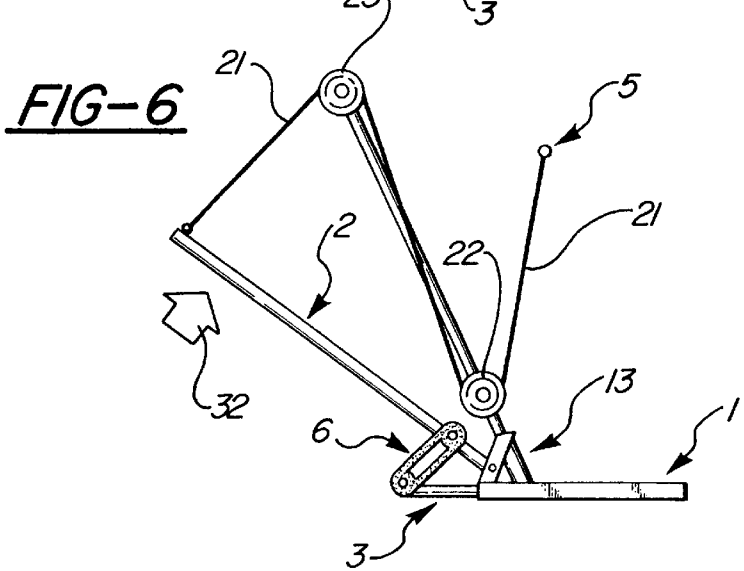
FIG. 6 is a view similar to FIG. 5 but showing the parts in adjusted positions.

FIGS. 2 and 5–8 illustrate several possible arrangements when the upright arm 4 is utilized. In the arrangement shown in FIG. 2, the end 21 of the arm 4 is fitted into the sleeve 15 of the mounting member 13 and the line 9 is reeved over the guide pulley 23 and under the guide pulley 22. This arrangement also is shown in FIGS. 5 and 6 so that, when a person stands upon the base 1 and applies an upward force on the actuator bar 5, the rocker arm 2 will be rocked in the direction of the arrow 32 (FIG. 6) against the resistance of the particular pair or pairs of resistance members 6–8 utilized.

Other arrangements are possible. For example, the arrangement shown in FIGS. 7 and 8 could be utilized wherein the upright arm 4 also is used, but the line 9 is reeved over the guide pulley 23 only, rather than about both of the pulleys 22 and 23. When a downward force is applied to the actuator 5, as is indicated by the arrow 33 (FIG. 8), the rocker arm 2 still will be rocked upwardly in the direction of the arrow 32 and against the resistance of the elastic members 6–8.

Figure 11:
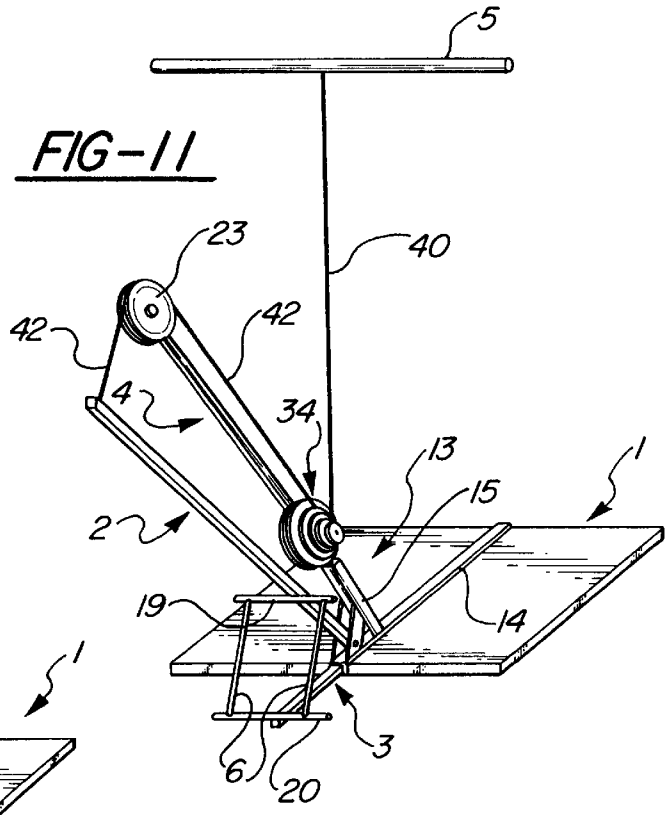
FIG. 11 is a view similar to FIG. 10, but showing the parts in adjusted positions.
Figure 10:
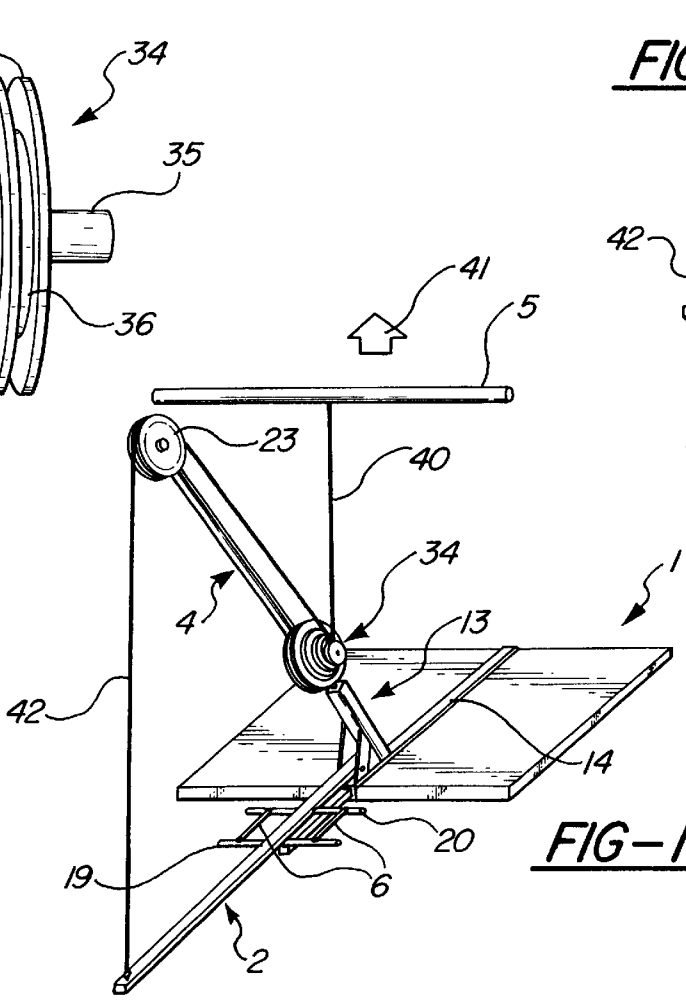
FIG. 10 is a diagrammatic, isometric view of apparatus incorporating the guide member shown in FIG. 9, the parts being in an at rest condition.
Figure 9:
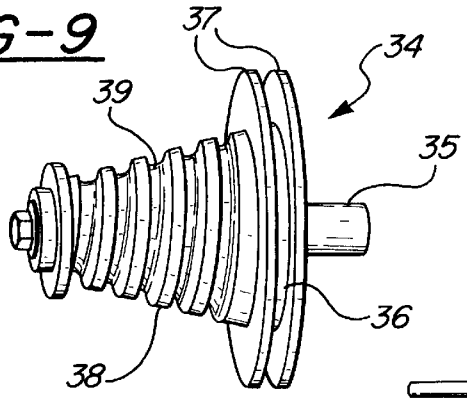
FIG. 9 is an isometric view of a modified form of force transmitting guide member that can be used in place of one of those shown in the other figures.

The embodiment shown in FIGS. 9–11 is substantially similar to the earlier described embodiment, but differs from the latter in that the lower guide pulley 22 on the upright arm 4 is replaced by a dual guide pulley 34 journalled on a spindle 35 and being rotatable about the same axis as that about which the pulley 22 rotated. The pulley 34 has a cylindrical hub 36 flanked by a pair of spaced retainer walls 37. Extending beyond one wall 37 is a conical projection 38 having an uninterrupted helical groove 39 therein.

To condition the apparatus shown in FIGS. 9–11 for use, one end of a flexible, force transmitting line 40 is fixed to the actuating bar 5 and the other end of such line is fixed to the hub 36 of the pulley 34. The line 40 initially has a plurality of turns wound on the hub between the walls 36 so that, when force in the direction of the arrow 41 is applied on the actuator bar 5 by the user, the pulley 34 will be rotated in a direction to cause the line 40 to be unwound from the hub.

Another force transmitting line 42 has one end thereof fixed to the conical projection 38 at the larger diameter end thereof and extends upwardly from the helical groove 39. From the conical projection the line 42 is reeved over the pulley 23 and the free end of such line is fixed to the free end of the rocker arm 2.

In the operation of the embodiment shown in FIGS. 9–11 the application of a force on the actuating bar 5 in the direction of the arrow 41 will cause rotation of the pulley 34 and rocking of the rocker arm 2 upwardly from the at rest position shown in FIG. 10 to the elevated position shown in FIG. 11. As the pulley 34 rotates, the point on the projection 38 which the line 42 engages the projection will move progressively from the larger diameter end of the projection toward the other and the rocker arm 2 will be rocked upwardly. Such upward movement will be yieldably resisted by the resistance members 6–8. As upward movement continues the force necessary to stretch the resistance members 6–8 will change. However, since the point of fresh engagement the line on the projection 38 constantly moves both axially and radially inward of the projection 38, the force that must be applied to the actuator bar 5 by the user to rock the rocker arm upwardly can remain substantially uniform throughout its upward movement. The guide pulley 34 therefore not only functions to effect rocking movements of the rocker arm, but also automatically compensates for variations in the force that is required to be applied to the rocker arm during its movements due to variations in resistance of the resistance members during stretching thereof.

Apparatus constructed in accordance with the disclosed embodiments enables a wide variety of exercises to be performed with relatively simple and rapid adjustments, most of which involve simply the use or nonuse of the upright arm 4 and, when the upright arm is used, the manner in which the force transmitting line is reeved around the guide pulleys. Among the exercises that may be performed are rowing; arm, wrist, and reverse curls; shrugs; squats; tricep extensions and push-downs; presses; crunches; dead lifts; and calf raises.

In all embodiments the geometry of the apparatus is such that it will accommodate large movements of the limbs of the user.

The disclosed embodiments are representative of presently preferred forms of the invention, but are intended to be illustrative rather than definitive thereof. The invention is defined in the claims.

I claim:

1. Exercise apparatus comprising a base having an upper surface on which a person selectively may stand, kneel, or sit; an elongate rocker arm; means pivotally coupling said rocker arm to said base at a level corresponding substantially to that of said surface and for rocking movements of said rocker arm about a first axis adjacent said surface from and to an at rest position in which said rocker arm is substantially coplanar with and extends beyond said surface of said base; a flexible force transmitting line connected to said rocker arm adjacent its opposite end and being operable to effect rocking movements of said rocker arm about said first axis; and yieldable resistance means reacting between said base and said rocker arm for yieldably resisting rocking movements of said rocker arm about said first axis from said at rest position and for returning said rocker arm to said at rest position.

2. The apparatus according to claim 1 including an upright secured at its lower end to said base and extending upwardly therefrom to a level beyond that of said surface, and at least one guide carried by said upright for guiding said line and around which said line may be trained.

3. The apparatus according to claim 2 wherein said guide is a pulley.

4. The apparatus according to claim 2 including two spaced apart guides carried by said upright and around either or both of which said line selectively may be trained.

5. The apparatus according to claim 4 wherein said guides are pulleys.

6. The apparatus according to claim 1 including an upright secured at its lower end to said mounting member, said mounting member having a socket in which said lower end of said upright removably is accommodated.

7. The apparatus according to claim 1 including anchor means carried by said base and said rocker arm and to which said resistance means is coupled.

8. The apparatus according to claim 1 wherein said base has an extension projecting therefrom and underlying said rocker arm when the latter is in said rest position, and wherein said resistance means is coupled to and extends between said extension and said rocker arm.

9. The apparatus according to claim 8 wherein said base includes a socket in which one end of said extension removably is accommodated.

10. Exercise apparatus comprising a base having an upper surface on which a person selectively may stand, kneel, or sit; a mounting member secured to said base; an upright carried by said mounting member in a fixed position and projecting upwardly therefrom; a rocker arm independent of said upright pivotally connected to one end of said mounting member for free rocking movements in opposite directions about a first axis adjacent said surface from and to an at rest position; flexible force transmitting means connected to said rocker arm at its opposite end and reacting with said upright for rocking said rocker arm about said axis from said at rest position; and yieldable resistance means acting on said rocker arm and yieldably resisting movement of said rocker arm about said axis from said rest position and returning said rocker arm to said at rest position.

11. The apparatus according to claim 10 including an anchor member carried by said base and underlying said rocker arm, said resistance means interconnecting said anchor member and said rocker arm.

12. The apparatus according to claim 11 wherein said resistance means comprises at least one elastic member having opposite ends secured to said rocker arm and said anchor member respectively, said rocker arm and said anchor member having projections thereon for accommodating a selected number of said elastic members.

13. The apparatus according to claim 10 wherein said force transmitting means includes at least one guide carried by said upright and around which said line is trained.

14. The apparatus according to claim 13 wherein at least one of said guides has a conical surface having a helical groove in which said line may be accommodated, said groove being continuous from one end thereof to its opposite end.

15. The apparatus according to claim 10 wherein said force transmitting means includes at least two spaced apart guides carried by said upright and around either or both of which said line may be trained.

16. The apparatus according to claim 10 wherein said resistance means varies in resistance as said rocker arm moves from its rest position and wherein said force transmitting means compensates for variations in said resistance of said resistance means.

17. The apparatus according to claim 16 wherein said force transmitting means includes a pulley rotatable about an axis and about which said line is wound and wherein said pulley has a radius which increases in one direction axially of said pulley.

18. The apparatus according to claim 10 herein said force transmitting means comprises a pulley rotatable about an axis, said pulley having a conical exterior in which a helical groove is formed, and a flexible line reeved around said pulley and accommodated in said groove, said line interconnecting said pulley and said rocker arm.

* * * * *

UNITED STATES PATENT AND TRADEMARK OFFICE

CERTIFICATE OF CORRECTION

PATENT NO. : 6,004,248
DATED : December 21, 1999
INVENTOR(S) : Shawn Price

It is certified that error appears in the above-identified patent and that said Letters Patent is hereby corrected as shown below:

Column 2, line 60, change "sleeve" to -- square tube --.

Column 3, line 3, after "axes" insert -- 24 --.

Claim 18, line 1, change "herein" to -- wherein --.

Signed and Sealed this

Fifth Day of September, 2000

*Attest:*

*Attesting Officer*

Q. TODD DICKINSON

*Director of Patents and Trademarks*